United States Patent [19]

Dabringhausen et al.

[11] 3,955,057

[45] May 4, 1976

[54] ELECTRIC SWITCH

[75] Inventors: Friedhelm Dabringhausen; Heinrich Neumaier, both of Mannheim, Germany

[73] Assignee: Brown, Boveri & Cie. A. G., Mannheim, Germany

[22] Filed: Sept. 30, 1974

[21] Appl. No.: 510,558

[30] Foreign Application Priority Data

Oct. 1, 1973 Germany ..... 2349331

[52] U.S. Cl. ..... 200/148 A; 200/150 G

[51] Int. Cl.[2] ..... H01H 33/88

[58] Field of Search ..... 200/148 A, 150 G

[56] References Cited

UNITED STATES PATENTS

| | | | |
|---|---|---|---|
| 3,659,065 | 4/1972 | Roidt et al. | 200/148 A |
| 3,739,125 | 6/1973 | Noeske | 200/148 A |

*Primary Examiner*—Robert S. Macon

*Attorney, Agent, or Firm*—Herbert L. Lerner

[57] ABSTRACT

Electric switch includes a fixed contact member and a movable contact member movable from a position wherein it is in contact with the fixed contact member to a position wherein it is spaced therefrom, one of the members having a nozzle-like inner channel, a blast piston-cylinder assembly surrounding the contact members in the contact position thereof wherein the switch is in switched-on condition, the cylinder and the piston being displaceable relatively toward one another in the switched-on condition of the switch so as to compress a gas received in the space between the piston and the cylinder, the fixed and movable contact member in the spaced position thereof, during switch-off of the switch, having an arc therebetween, the arc being blown by an extinguishing flow through the nozzle-like inner channel of the gas compressed by the piston and cylinder assembly, the piston having a base secured to the movable contact member drive means for substantially uniformly actuating on the cylinder, the compressive force of the compressed gas on the piston base driving the movable contact member into switched-OFF position of the switch, and means located between the cylinder and the movable contact member for controlling the course of travel of the movable contact member relative to that of the cylinder.

19 Claims, 6 Drawing Figures

ELECTRIC SWITCH

The invention of the instant application relates to an electric switch and, more particularly, to such an electric switch which has a fixed contact member and a movable contact member movable from a position wherein it is in contact with the fixed contact member to a position wherein it is spaced therefrom, one of the members having a nozzle-like inner channel, a blast piston-blast cylinder assembly surrounding the contact members in the contact position thereof wherein the switch is in switched-on condition, the cylinder and the piston being displaceable relatively toward one another in the switched-on condition of the switch so as to compress a gas received in the space between the piston and the cylinder.

An electric switch has become known heretofore from German Published Non-Prosecution Application DOS 2,030,605 which operates according to the impression system by which the extinguishing gas flow is produced by means of a blast piston system mounted on the switch. In this regard, there are provided a fixed contact member having an inner channel of nozzle-like construction and a movable contact member. A cylindrical structure is mounted on the movable contact member, and is connected by means of a gas line to the extinguishing chamber space i.e. to the space wherein the extinguishing contact point is located. A piston structure engages in this cylinder space, and is, in principle, stationary or fixed with respect to the fixed contact member. During a switch-off action, the movable contact member, and the gas present within the cylinder structure is compressed by the fixed piston structure and rapidly fed through the gas line to the extinguishing contact point.

A fundamental problem occurring with such heretofore known electric switches is that not only the movable contact member, but also the cylinder structure must be driven simultaneously by the driving device. This occurs in the case of the aforedescribed heretofore-known switch because the movable contact member and the cylinder structure are connected one to the other so that they both move in the same sense and with equal acceleration. This is disadvantageous, however, as it has been found that to attain an optimum blowing, the movable contact member should be briefly stationary during a switch-off action into the so-called extinguishing position. This can be achieved with the aforedescribed heretofore-known switch only if the cylinder structure is also stationary. With regard to a good blowing action upon the arc, this is disadvantageous.

An electric switch has also become known heretofore that has two fixed, oppositely disposed contact members having inner channels of nozzle-like construction, which are embraced by a movable contact structure in switched-on position. Both contact members and the movable contact structure are in turn surrounded by a blast cylinder which serves to produce the extinguishing gas flow for blowing upon the electric arc. During the switch-off action, the blast cylinder connected to the movable contact structure is drawn over a stationary blast piston, and the gas imprisioned between both is compressed. The gas flow introduced after contact separation blows on the electric arc which extends initially between one of the two stationary contact members and the movable contact structure. The electric arc, at any rate, during the further course of the switch-off action, must be commutated to the second stationary contact member. It is in fact, in the last-mentioned, that the main disadvantage lies, since a commutation is always fraught with special problems. Furthermore, the pressure-tight guidance of the movable contact structure toward the one stationary contact member is also very problematical because of the tolerances that must thereby be maintained.

It is accordingly an object of the invention to provide an electric switch of the aforementioned general type wherein the disadvantages of the heretofore-known switches of that type are eliminated. A more specific object of the invention is to provide the electric switch with a movable contact member that is not driven mechanically.

With the foregoing and other objects in view, there is provided in accordance with the invention an electric switch comprising a fixed contact member and a movable contact member movable from a position wherein it is in contact with the fixed contact member to a position wherein it is spaced therefrom, one of the members having a nozzle-like inner channel, a blast piston-cylinder assembly surrounding the contact members in the contact position thereof wherein the switch is in switched-on condition, the cylinder and the piston being displaceable relatively toward one another in the switched-on condition of the switch so as to compress a gas received in the space between the piston and the cylinder, the fixed and movable contact members in the spaced position thereof, during switch-off of the switch, having an arc therebetween, the arc being blown by an extinguishing flow through the nozzle-like inner channel of the gas compressed by the piston and cylinder assembly, the piston having a base secured to the movable contact member drive means for substantially uniformly actuating on the piston base driving the movable contact member into switched-OFF position of the switch, and means located between the cylinder and the movable contact member for controlling the course of travel of the movable contact member relative to that of the cylinder.

Through the invention of this application, the coupling between the blast cylinder and the movable contact member is no longer mechanically fixed or rigid, as in the heretofore-known switches of this general type, but rather both are mechanically independent of one another. A result thereof can be that the blast cylinder can be brought evenly or steadily into the switched-off position, while the movable contact member, however, is brought with a desired uneven course of travel into that position. In the case at hand, only the blast cylinder is driven, so that complex mechanics are not required for coupling blast cylinder and contact member one to another.

Other advantageous embodiments and improvements of the invention are also to be derived from the dependent claims appended hereto and forming part of the disclosure herein.

Other features which are considered as characteristic for the invention are set forth in the appended claims.

Although the invention is illustrated and described herein as embodied in electric switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
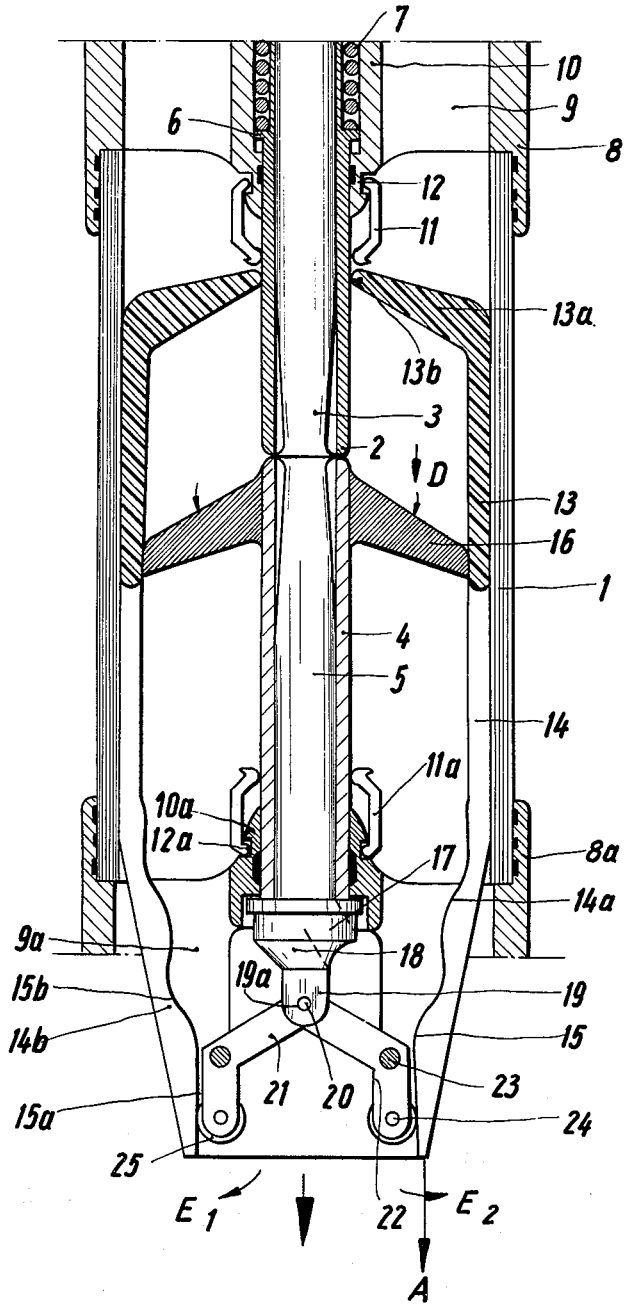
FIG. 1 is a diagrammatic longitudinal sectional view of a first embodiment of an electric switch constructed in accordance with the invention shown in ON position.
Figure 2:
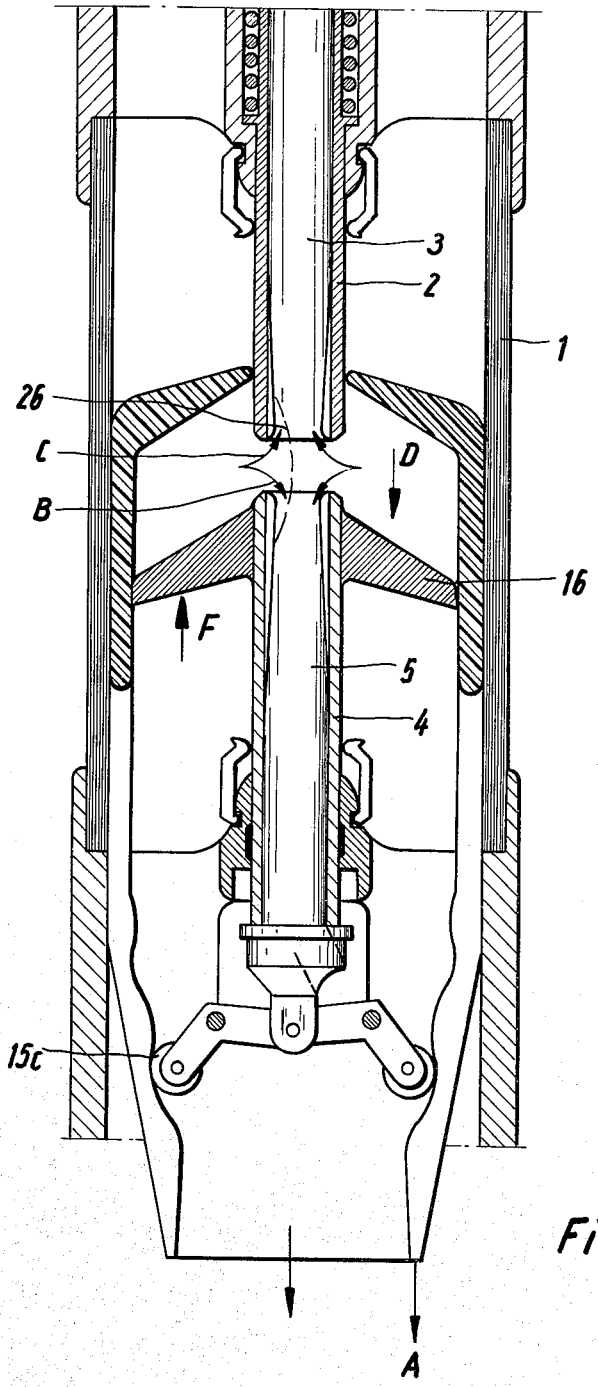
FIG. 2 is a view similar to that of FIG. 1 but showing the first embodiment of the electric switch in quenching or extinguishing position.
Figure 3:
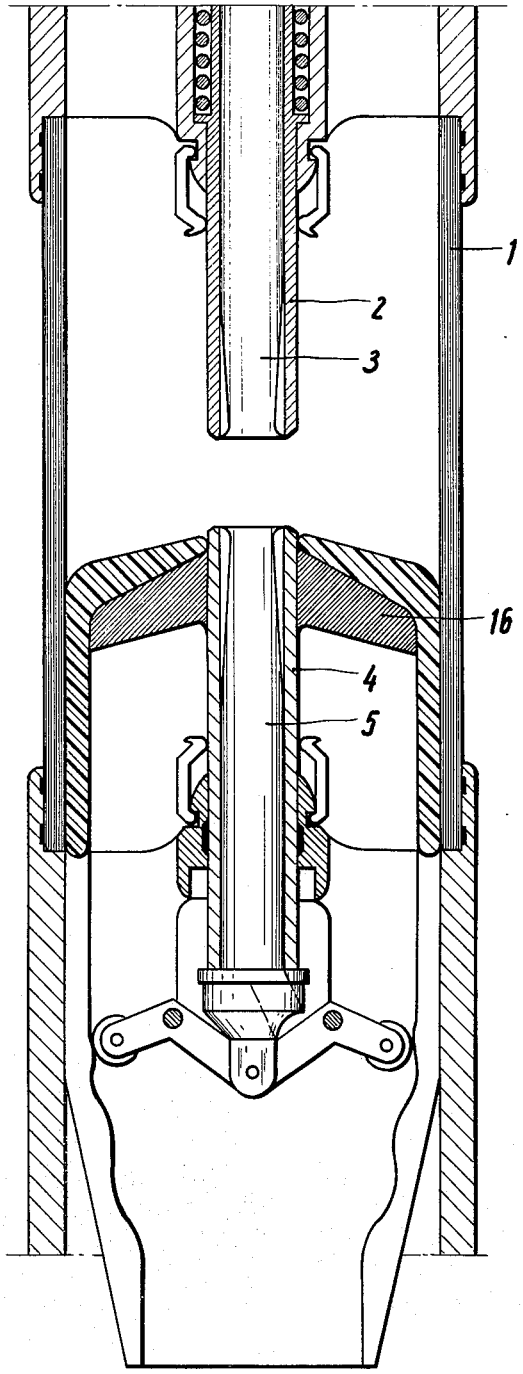
FIG. 3 is another view similar to those of FIGS. 1 and 2 showing the first embodiment of the electric switch in OFF position.

Referring now to the drawing and first particularly to FIGS. 1 to 3 thereof, there is shown an electric switch, constructed in accordance with the invention, which includes an insulating tube 1 within which an extinguishing contact point is located. With respect thereto, a "fixed" contact member 2 formed with a nozzle-like inner channel 3 and a movable contact member 4 also formed with a nozzle-like inner channel 5 are provided. The "fixed" contact member 2 is not actually fixed in position within the insulating tube 1 but rather is constructed so as to follow the movable contact member 4, along a path, however, which is relatively short compared to the overall travel path of the movable contact member 4 during a switching-off action. A shoulder 6 against which a compresson spring 7 abuts is formed on the "fixed" contact member 2. The compression spring 7 provides for the "fixed" contact member 2 to follow the movable contact member 4. The insulating tube 1 is gripped at its upper end by an upper holder 8 and at its lower end by a lower holder 8*a*, as viewed in FIGS. 1 to 3. Ribs 9 and 9*a* are formed respectively, at the inner surface of each of the holders 8 and 8*a*, and the ribs 9 and 9*a* per se, in turn, support respective inner conductors 10 and 10*a*. Contact fingers 11 and 11*a* are electrically conductively connected to both of the inner conductors 10 and 10*a*, respectively. In this regard, each inner conductor 10, 10*a* is formed with a respective groove 12, 12*a* as bearing for the respective contact finger 11, 11*a*. In the ON condition which is shown in FIG. 1, the extinguishing contact point i.e. the point at which the "fixed" contact member 2 and the movable contact member 4 are in contact, is surrounded by a blast cylinder 13 which is provided with a base 13*a* formed with an opening 13*b*. The inner diameter of the opening 13*b* of the blast cylinder base 13*a* corresponds to the outer diameter of the "fixed" contact member 2, thereby ensuring a tight fit at the contact line between the opening 13*b* and contact member 2. A connecting member 14 is formed on the blast cylinder 13 and has a fork-shaped free end. This end is identified by reference characters 14*a* and 14*b* and is referred to hereinafter as the fork-shaped end.

At the inner side of each fork 14*a* and 14*b* a control cam surface 15 is provided which has a course extending in axial direction of the switch that corresponds to the travel course of the movable contact member 4 during a switching-off action. At the end of the movable contact member 4 adjacent the extinguishing contact point, a piston base 16 having an outer daimeter corresponding to the inner diameter of the blast cylinder 13 is secured. The contact surface between the piston base 16 and the blast cylinder 13 is pressure-tight. At the end of the movable contact member 4 located opposite the extinguishing contact point, there is mounted a cap 18, which closes off the inner channel 5 and grips the movable contact member 4 outside at the end region thereof. To permit gases to flow out of the inner channel 5, outlet openings 17 are provided which are pressure-tightly covered by the inner conductor 10*a* in the ON position (FIG. 1), but are exposed and permit passage of the gases out of the inner channel 5 in the extinguishing and OFF positions (FIGS. 2 and 3, respectively). A strap-joint 19 is formed on the cap 18 and is provided with a bore 19*a* through which a pin 20 extends. By means of the pin 20, two levers 21 having a knee-like angle are articulatingly connected with the strap-joint 19. In the knee 22 of each lever 21, both of the latter are fixedly mounted so as to be rotatable about a pivot shaft 23. Another shaft 24 on which a roller 25 is rotatably mounted is located at the free end of each lever 21.

The operation of the switch according to the invention is as follows:

During switching-off action, the blast cylinder 13 is drawn by a non-illustrated drive in direction of the arrow A. The movement of the blast cylinder 13 occurs at a nearly constant speed. During this movement, the volume of the space between the base 13*a* of the blast cylinder 13, on the one hand, and the base 16 of the piston, on the other hand, is diminished and the gas in this space id compressed. During the initial compression phase, the rollers 25 run on the cylindrical partial region 15*a*; in this connection, due to the spatially fixed bearing of the shaft 23, the movable contact member 4 cannot move. When the blast cylinder 13 moves farther, the rollers 25 then reach the enlarged diameter or widened part 15*b* and the free ends of the lever 21 can move outwardly in direction of the arrows E and E2. Since the compressive force D of the compressed gas acts upon the piston base 16, the movable contact member 4 moves in direction of the arrow A, the "fixed" contact member 2 traveling behind the movable contact member 4 because the "fixed" contact member is subjected to the biasing force of the compression spring 7 in OFF direction. The movement of the movable contact member 4 occurs analogously to the control cam surface 15. After having run through the region 15b, the rollers 25 reach another cylindrical or axially parallel region 15*c* wherein the mutual spacing between both rollers 25 is maintained constant, and the movable contact member 4 is thereby brought to a halt. The position or setting wherein the movable contact member 4 is then found is called the extinguishing position and is illustrated in FIG. 2. In that position an arc 26 is formed because both of the contact members 2 and 4 have been relatively displaced one from the other. The extinguishing gas then flows in direction of the arrows B and C through the inner channels 3 and 5 and blows on the arc 26. In this position or setting, the arc 26 then becomes extinguished. When the rollers 25 have traveled over the region 15*c*, the movable contact member 4, yet always under the influence of the compressed gas, can move farther into the OFF position or setting (FIG. 3). The switch is shut off.

For switching-on purposes, the blast cylinder is again, together with the movable contact member 4, brought into the ON-position. It is possible to provide a non-illustrated second position base at the connecting member 14 whereby, during the switching-on operation, the gas present between the second piston base and the first piston base 16 at the movable contact member 4 is compressed and thus applied to the piston base 16 in direction of the arrow F. So that above all the blast cylinder can be brought in ON-position, it is necessary to insert closable openings in the second piston base which open when a given pressure is exceeded in the space between both piston bases, and thus ensure pressure equalization. For this purpose, spring-loaded seat valves or check valves can be provided. They are not illustrated primarily in the interest of clarity. Similarly, closable openings are also to be inserted in the blast cylinders to assure pressure equalization with the surroundings. When the blast cylinder, namely, is brought into ON-position, negative pressure occurs in the space between piston base and blast cylinder base as soon as the contact point is closed, the blast cylinder, however, continuing to travel. The gas flow then required would have to follow then into the blast cylinder.

Figure 4:
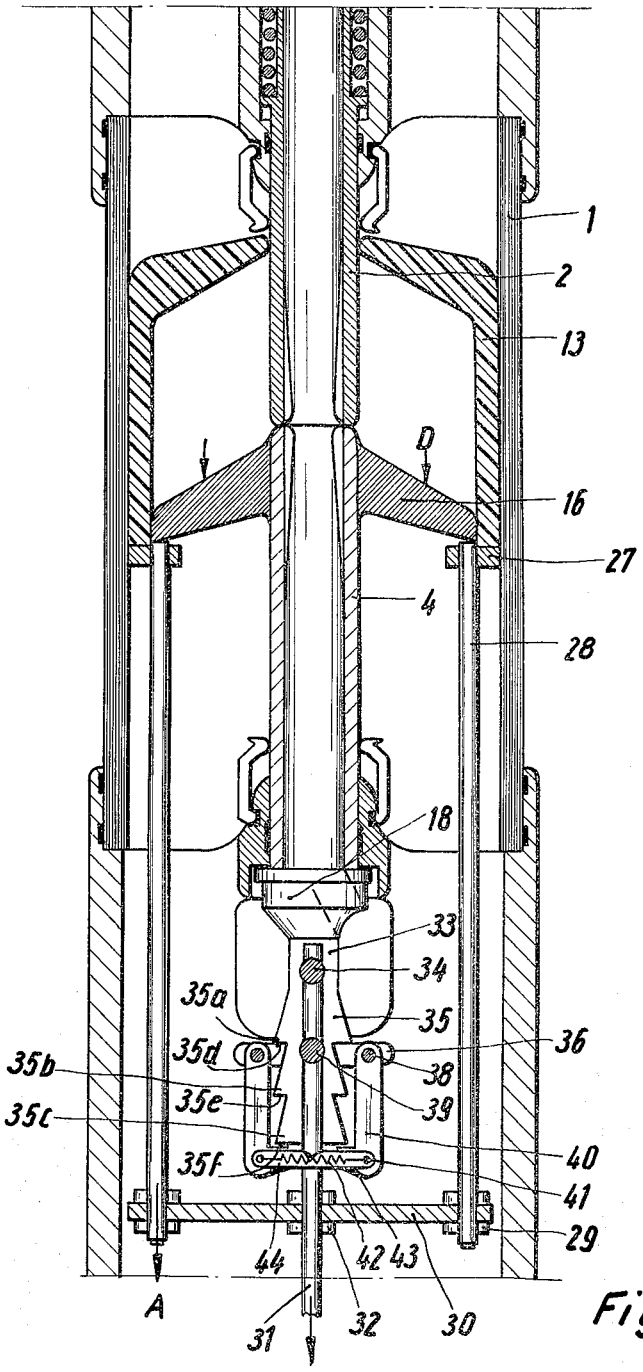
FIG. 4 is a diagrammatic longitudinal sectional view of a second embodiment of an electric switch according to the invention shown in ON position.
Figure 5:
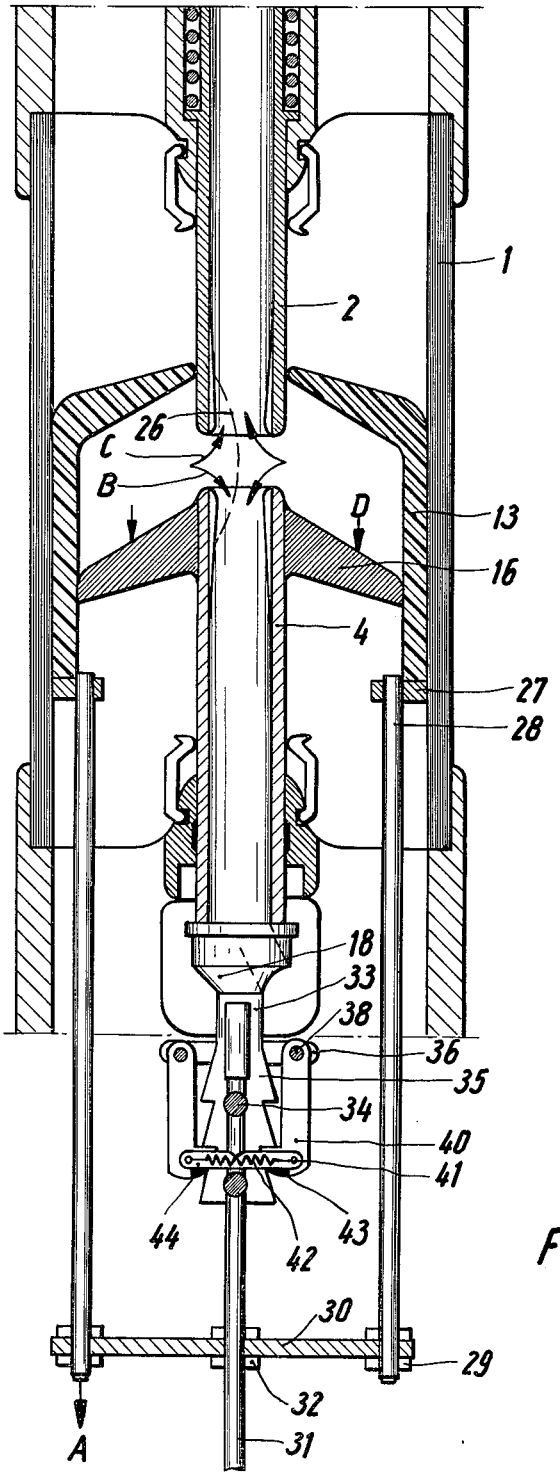
FIG. 5 is a view similar to that of FIG. 4 but showing the second embodiment of the electric switch in quenching or extinguishing position.
Figure 6:
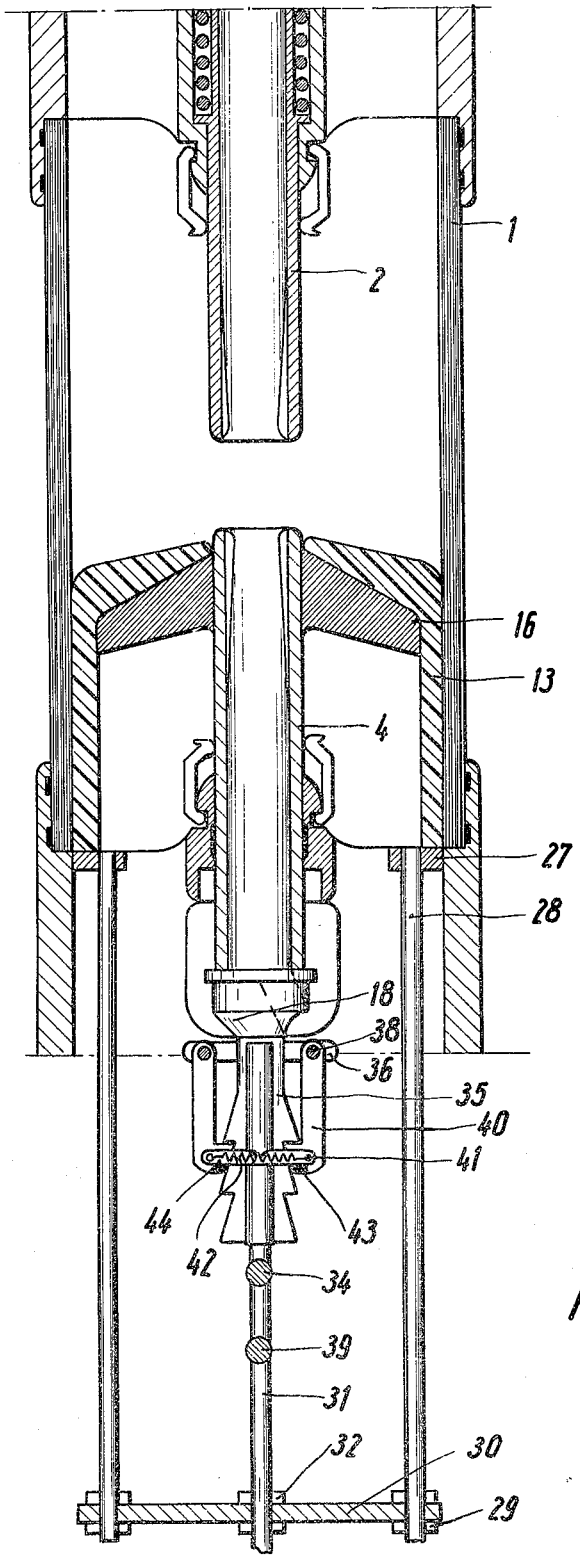
FIG. 6 is another view similar to those of FIGS. 4 and 5 showing the second embodiment of the electric switch in OFF position.

Another embodiment of the device for controlling the extent of travel of the movable contact member during a switch-off action is shown in FIGS. 4 to 6 in various phase positions thereof. Instead of sensing or following a control cam surface by means of a lever-roller device, as in the embodiment of FIGS. 1 to 3, a mechanism is provided in the embodiment of FIGS. 4 to 6 which holds fast and releases the movable contact member in two positions, respectively.

In principle, the switch of FIGS. 4 to 6 is constructed in a manner similar to that of the switch of FIGS. 1 to 3. Also, in the embodiment of FIGS. 4 to 6, the movable contact member 4 is driven by compression of gas in the space between the blast cylinder base and the piston base 26 mounted on the movable contact member 4. In order that the movement of the movable contact member 4 in the embodiment of FIGS. 4 to 6 be carried out in the same manner as that of the switch in FIGS. 1 to 3, that is, during a switch-off action, remains stationary relative to the blast cylinder 13 which has already started to move, then rapidly runs into the extinguishing position, again abides in that position for a given period of time and finally reaches the OFF-position, the lever mechanism is constructed as follows:

A holder 27, which connects with the blast cylinder 13 two tie rods 28 that are in turn connected to a non-illustrated driving device, is mounted on the blast cylinder 13. Respective free ends of the tie rods 28 are fastened by nuts 29 to a plate which carries, in the middle thereof, a control rod 31, also fastened to the plate 30 by means of nuts 32.

At the cap 18 on the movable contact member 4, a fork 33 is secured, the outer surfaces of which are provided with opposing dwell or catch cams 35. Altogether, three dwell or catch cams 35*a*, 35b and 35*c* are located on each surface. Each dwell or catch cam 35 is of sawtooth-shaped construction and is provided with a respective surface 35*d*, 35*e*, 35*f* extending perpendicularly to the switch axis and located at the side of the dwell or catch cam 35 facing away from the extinguishing contact point. A shaft 38 is fixedly mounted, respectfully, on opposing ribs 9*a* and are mutually connected by a transverse strap 36. It is also possible to provide a stationary bearing or support for the transverse strap 36 and to secure the shafts 38 at both ends of the strap 36. This is, at any rate not shown herein. A ratchet or latch lever 40 of L-shaped construction is rotatably linked to the respective shafts 38. A shaft 41 is provided at the respective corners of the L-shaped levers 40 and has a respective hook-shaped end of a spring 42 slung around it. The spring 42 is of helical construction and is only slightly stressed in tension when both latch levers 40 assume the position thereof shown in FIG. 4. Straps 44 are furthermore pivoted at each of the shafts 41 and extend inwardly therefrom toward the axis of the switch. The shorter leg of the L-shaped ratched or latch lever 40, that also extends inwardly, is formed with a nose 43, the function of which will be described hereinafter in greater detail. Two pins 34 and 39 are secured to the control rod 31, the spacing therebetween, on the one hand and the spacing of the pin 39 to the straps 44, on the other hand, corresponds, in the ON-condition, to the spacing extinguishing position-OFF position or ON-position - extinguishing position. The noses 43 are on the side of the straps 44 located opposite the extinguishing contact point so that the straps 44 cannot rotate about the respective shafts 38 away from the extinguishing contact point, but rather, in opposite direction thereto. Through the particular disposition of the spring 42 and through the connection thereof to the straps 44, the latter, in neutral position thereof, are always pressed against the noses 43.

The operation of the assembled embodiment of the switch shown in FIGS. 4 to 6 is as follows:

When the switch is to be shut off, the blast cylinder 13 is then drawn together with the control rod 31 in direction of the arrow A. The gas in the space within the blast cylinder 13 is thereby compressed and the gas exerts a compressive force D on the piston base 16. The surfaces 35*f* abut the short leg of the ratchet or latch lever 40, so that the movable contact member 4 is firmly held in this position. The pin 30 travels downwardly, thus also in direction of the arrow A. It is accordingly pressed against the straps 44 which cannot turn away from the extinguishing contact point because the noses 43 at the ratchet or latch levers 40 prevent them from doing so. The pin 39 forces itself between and past the straps 44, thereby pressing the latter and the latch or ratchet levers 40, therewith, away from one another. The short leg of the respective ratchet or latch levers 40 thereupon free the respective catch cams or noses 35*c*: under the effect of the compressive force D, the movable contact member 4 is displaced in direction of the arrow A. After the pin 39 has passed the straps 44, the latch or ratchet levers 40 are again drawn together into mutual linear alignment by the spring 42 and the short legs of the levers 40 firmly hold the movable contact member 4 fast by the abutment of the short legs of the lever 40 against the surfaces 35*e* of the catch cams or noses 35*b*. Both of the contact members 2 and 4 had been mutually separated from one another and are now located in the extinguishing position as shown in FIG. 5. In the latter position, the electric arc 26 has been formed that is subjected to the blast of compressed gas that is found in the space within the blast cylinder 13. The gas thus flows in direction of the arrow C through and out of the inner channels of both contact members 2 and 4. In this position, the arc 26 becomes extinguished.

When the control rod 31 with both pins 34 and 39 is moved farther, the pin 34 then reaches the straps 44 and forces both ratchet or latch levers 40 apart in the same manner as described hereinbefore. The levers 40 free the catch cams or noses 35*b*, and the movable contact member 4 travels farther into the OFF-position of FIG. 6 wherein it is held in the latter position by the abutment of the ratchet or latch levers 40 against the surfaces 35*d*. The movable contact member 4 travels from the position thereof shown in FIG. 5 into that of FIG. 6 through the action of additional compressed gas contained in the blast cylinder 13. This additional compressed gas can, in fact, flow away through the inner channels. The compression of the remaining gas is actually sufficient for driving the movable contact member 4 into the OFF position of the switch. In order to switch-on the switch again, the direction of movement of the drive device is reversed; the connecting rods 28 engage the piston base 16 and force the movable contact member 4 into the ON-position. The pins 34 and 39 on the control rod 31 travel readily between and past the straps 44 because the latter are able simply to turn away.

In addition to the aforedescribed embodiments for controlling the course of travel of the movable contact member 4, other possibilities are contemplated and are within the scope of the invention of the instant application. Thus, instead of the linear-extending control cam surface 15 of FIGS. 1 to 3 and the linear drive, it is possible, for example, to provide a polar-extending control cam surface which is mounted in a circular disc. The latter is provided at the outer periphery thereof with toothing that meshes with a toothed rack which is connected to the blast cylinder 13. To drive the blast cylinder 13, the circular disc is set in rotation; a pin provided on the movable contact member 4 and that engages with the control cam surface controls the displacement of the movable contact member 4.

It is claimed:

1. Electric switch comprising a fixed contact member and a movable contact member movable from a position wherein it is in contact with said fixed contact member to a position wherein it is spaced therefrom, one of said members having a nozzle-like inner channel, a blast piston-cylinder assembly surrounding said contact members in said contact position thereof wherein the switch is in switched-on condition, said cylinder and said piston being displaceable relatively toward one another in said switched-on condition of the switch so as to compress a gas received in the space between said piston and said cylinder, said fixed and movable contact members in said spaced position thereof, during switch-off of the switch, having an arc therebetween, said arc being blown by an extinguishing flow through said nozzle-like inner channel of the gas compressed by said piston and cylinder assembly, said piston having a base secured to said movable contact member drive means for substantially uniformly actuating only said cylinder, the compressive force of the compressed gas on said piston base driving said movable contact member into switched-OFF position of the switch, and means located between said cylinder and said movable contact member for controlling the course of travel of said movable contact member relative to that of said cylinder.

2. Electric switch according to claim 1 comprising a connecting member located between said drive means and said cylinder and having an inner side formed with at least one control cam surface, and lever means mounted on said movable contact member for sensing said control cam surface so as to control the course of travel of said movable contact member into the switched-off position of the switch.

3. Electric switch according to claim 2 wherein said lever means comprises at least one lever mounted on said movable contact member, said one lever being rotatable about a locally fixed axis and having a free end engaging with said control cam surface.

4. Electric switch according to claim 3 wherein said free end of said lever is formed with a slide surface slideably along said control cam surface.

5. Electric switch according to claim 3 including a roller rotatably mounted at said free end of said lever and rollable on said control cam surface.

6. Electric switch according to claim 3 wherein said lever is constructed as a bellcrank and is supported at the bend therein.

7. Electric switch according to claim 3 wherein each of said levers is formed with a slotted hole at one end thereof and including a strap mounted on said movable contact member, and a pin carried by said strap and extending through each of said slotted holes of said levers.

8. Electric switch according to claim 2 wherein said control cam surface is formed with at least two axially paralled partial regions of varying axial spacing so that during uniform movement of said cylinder into switched-off position, one of said partial regions of varying axial spacing of said movable contact member is reached.

9. Electric switch according to claim 2 wherein said connecting member is constructed in the shape of a fork embracing said movable contact member and said lever.

10. Electric switch according to claim 2 wherein said connecting member is of substantially cylindrical construction.

11. Electric switch according to claim 2 wherein said cylinder is formed of insulating material and said connecting member of metal.

12. Electric switch according to claim 1 wherein said piston base is formed of metal.

13. Electric switch according to claim 1 wherein said piston base is formed of insulating material.

14. Electric switch according to claim 1 including an additional piston base provided at said connecting member, said additional piston base being located at the side of the first-mentioned piston base opposite said extinguishing contact position of said contact members, said movable contact member, in a switch-on action, being driven by the gas present in the space between the first-mentioned piston base and the additional piston base into switched-on position.

15. Electric switch according to claim 2 including at least two catch cams mounted axially behind one another on said movable contact member, at least one ratchet lever cooperating with said catch cams so that said movable contact member, in a switch-off action, being retained in at least two positions by said ratchet lever and, in a switch-on action, travels freely however, the retention and freeing of said movable contact member by said ratchet lever being dependent upon the position of said blast cylinder.

16. Electric switch according to claim 15 wherein said ratchet lever has a fixed mounting and is resiliently biased inwardly against said catch cams, and including control rod means connected to said blast cylinder, and at least one pin disengaging said ratchet lever from said catch cams provided on said control rod means.

17. Electric switch according to claim 16 including a respective strap rotatably mounted at an end of each ratchet lever, a nose provided on the ratchet lever at the side of the strap that is located opposite the contact point of both contact members, said nose serving to block rotary motion of said straps away from said contact point so that said straps, during travel of said pin into switched-off position, are forced outwardly against said noses and thereby said ratchet levers, nevertheless, during travel of said pin into switched-on position, pass said pin through without affecting said ratchet levers.

18. Electric switch according to claim 1 wherein said means for controlling the course of travel of said movable contact member relative to that of said cylinder comprises a fixed rotatably mounted cam disc, and including sensing means movable along said cam disc during a switch-off action, toothing means connecting said cam disc to said blast cylinder so that said cam disc is driven during a switch-off action.

19. Electric switch according to claim 18 including means for disengaging said sensing means from said cam disc, during a switch-off action, so that said course of travel of said movable contact member relative to that of said cylinder is uniform.

* * * * *